US005960909A

United States Patent [19]

Horcher et al.

[11] Patent Number: 5,960,909

[45] Date of Patent: Oct. 5, 1999

[54] DEVICE FOR LIFTING A PERSON FROM A POOL

[75] Inventors: Stefan Horcher; Willi Horcher, both of Schöneck, Germany

[73] Assignee: Horcher GmbH, Nidderau, Germany

[21] Appl. No.: 08/998,929

[22] Filed: Dec. 29, 1997

Related U.S. Application Data

[63] Continuation-in-part of application No. 08/563,586, Nov. 28, 1995, abandoned.

[51] Int. Cl.[6] ..... B66B 9/08

[52] U.S. Cl. ..... 187/200

[58] Field of Search ..... 187/270, 200, 187/901, 373, 201, 202; 414/921

[56] References Cited

U.S. PATENT DOCUMENTS

| | | | |
|---|---|---|---|
| 4,183,106 | 1/1980 | Grimes et al. | 187/901 |
| 4,399,570 | 8/1983 | Tracy et al. | 187/901 |
| 4,407,498 | 10/1983 | Clore et al. | 187/188 |
| 4,467,889 | 8/1984 | Maubach et al. | 187/270 |
| 4,633,538 | 1/1987 | James | 187/200 |
| 4,664,584 | 5/1987 | Braun et al. | 187/901 |
| 4,928,330 | 5/1990 | Moore | 414/921 |
| 5,180,275 | 1/1993 | Czech et al. | 187/200 |
| 5,595,265 | 1/1997 | Lebrocquy | 414/921 |

*Primary Examiner*—William E. Terrell
*Assistant Examiner*—Khoi H. Tran
*Attorney, Agent, or Firm*—Dennison, Meserole, Scheiner & Schultz

[57] ABSTRACT

The invention relates to a person lifter (10), particular a pool lifter, including a rotatable column (12) that begins at a base mount (22), and with a person holder (18), such as a seat or gurney, that can be raised or lowered by a lifting arm (16) along the longitudinal axis (14) of the column. In order to stop the person holder in the event of a malfunction, or if the lowering speed of the person holder is excessively high, the lifting arm (16) begins at a first driven belt (conveyor belt) (26) guided in the column (12), parallel to which a second belt (28) (catch belt) guided in the column and joined to the lifting arm (16) is arrested if the lowering speed of the person holder exceeds a predetermined value.

11 Claims, 4 Drawing Sheets

DEVICE FOR LIFTING A PERSON FROM A POOL

This application is a continuation-in-part of application Ser. No 08/563,586 filed Nov. 28, 1995 now abandoned.

The invention relates to a person lifter, in particular a pool lifter, including a rotatable column that begins at a base mount, with a person holder, such as a seat or gurney, that can be raised or lowered along the longitudinal axis of the column.

In order to transfer handicapped persons, especially, into a basin or bath tube from a wheelchair or bed, for instance, so-called pool or basin lifters are used. They include a column along which a seat or gurney can be displaced; the seat or gurney begins at an arm that is secured to the column by one end, to enable raising or lowering in this way. The lifting arm may for instance be connected to a chain or belt guided inside the column. If the chain or belt should break, the lifting arm and hence the seat or gurney would slide downward at an excessively high speed, with the risk of injury to a person sitting on the seat or lying on the gurney.

The object of the present invention is to further develop a person lifter, in particular a pool lifter, of the type referred to at the outset in such a way that while having a simple design, safe raising and lowering of persons is possible, and in which it is assured that the person holder will come to a stop if its lowering speed is excessively high. Easy transfer of a person from the person holder to a wheelchair or bed or vice versa should also be possible.

This object is attained in accordance with the invention essentially in that the holder begins at a first belt (conveyor belt), which is driven in the column; a second belt (catch belt), guided in the column and joined to the holder or to the first belt, extends parallel to the first belt and can be arrested if the lowering speed of the person holder exceeds a predetermined value.

The hoisting belt is wound on and off a shaft. The hoisting belt is pulled up or lowered within the column's u-shaped guide parallel to the column. At its free end the belt, at the end furthest from the shaft, connected to a securing attachment from which a lifting arm extends to a seat. The securing attachment is driven similar to a shuttle within the u-shaped guide. An additional u-shaped guide containing the catch belt is placed parallel to the guide enclosing the hoisting belt. The catch belt is also connected at the end with the securing attachment. At the shaft the catch belt is attached to a fastening device such as those familiar from car seat safety belts. This means that whenever the belt is pulled too quickly from a spring-loaded shaft, said shaft locks precluding any further unwinding.

According to the invention, two belts are guided parallel to one another in the column of the person lifter and are joined to one another via the person holder or its lifting arm leading to the column; one of the belts is driven and enables raising or lowering the person holder, while the other belt acts as a safety belt, in order to preclude uncontrollably fast lowering of the person holder, for instance if the drive belt breaks.

The connection between the belts can be made via a from which the lifting arm of the person holder extends.

The drive of the conveyor belt is effected via a rechargeable battery which is replaceably secured in the rear of the column, relative to the location of the person holder.

Both in the region of the person holder and the region of the replaceable battery, control switches are provided, and an emergency off switch is provided particularly in the region of the electric battery.

In a feature of the invention that should be especially emphasized, the column is rotatably disposed on a shaft end that begins at the base mount. As a result, transposition of the column becomes possible by simple provisions. All that is needed for this is that the column be lifted from the shaft end, and the base mount can then be disposed at some other place. The column can then be mounted on the shaft end again.

An arresting element also begins at he column, to enable locking the column. As a result, a risk-free transfer from a wheelchair or bed to the person holder, or in other words to a seat or gurney, or vice versa, is possible without the column being able to rotate out of position, which would present the danger that the person would slide downward. A corresponding locking means can be embodied in the form of an eccentric brake embodied such that an element actuatable by a lever can be pressed against the shaft or shaft end when the column is to be arrested. In addition, extending from the lever an externally threaded bolt passes through the column, rotating into an internally-threaded sleeve. Depending on the direction of rotation of the lever, and thus of the bolt, the bolt is either moved in the direction of the shaft or away from it. This makes it possible to tighten the bolt against the shaft. In this position the column can no longer rotate around the shaft.

Further details, advantages and characteristics of the invention will become apparent from the following, the description of a preferred exemplary embodiment shown in the drawings.

DETAILED DESCRIPTION OF THE INVENTION

Figure 2:
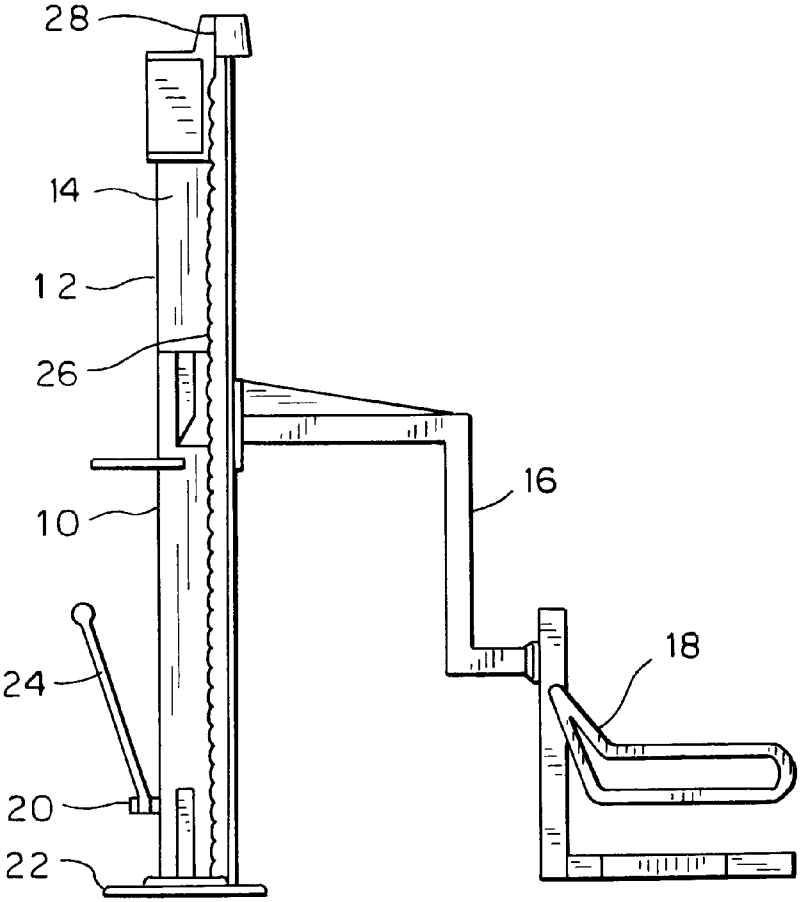
FIG. 2 is a rear view of the person lifter, shown partly cut away.
Figure 1:
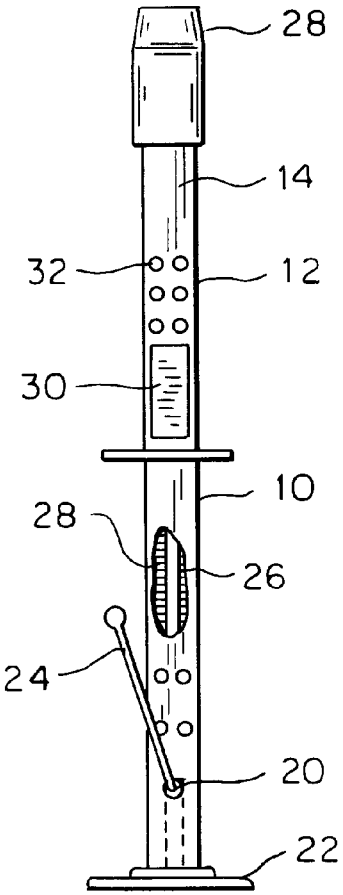
FIG. 1 is a side view of a person lifter according to the invention.
Figure 4:
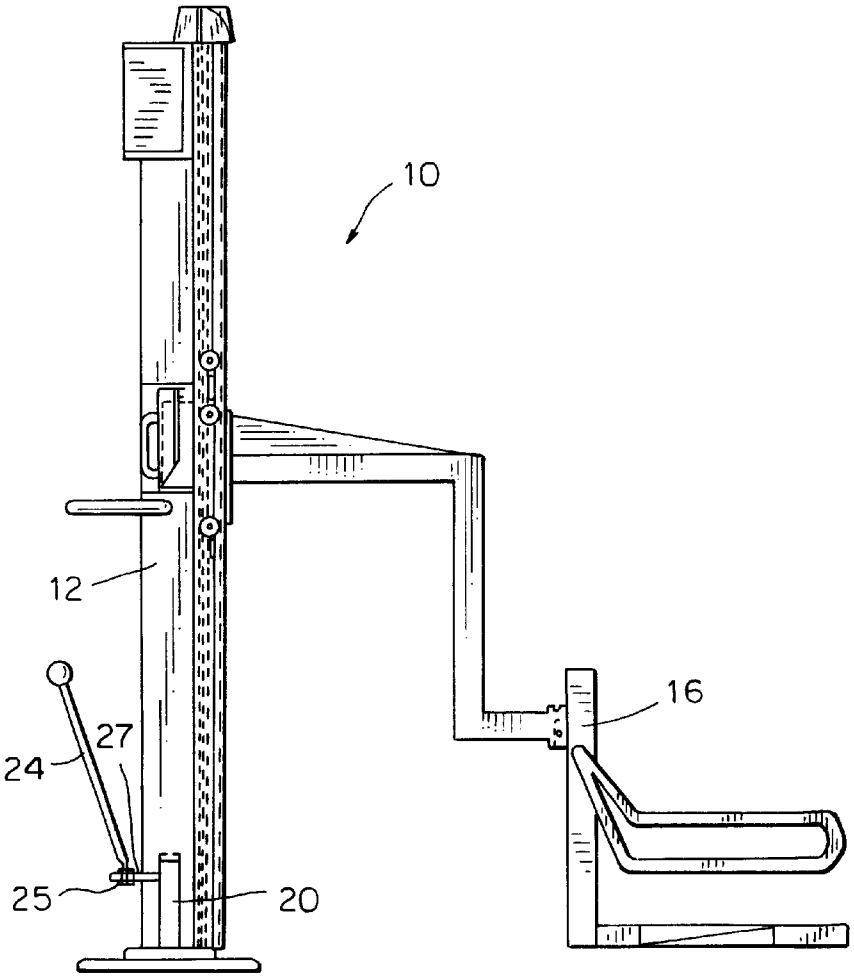
FIG. 4 is an enlarged drawing of the person lifter as shown in FIG. 2.
Figure 3:
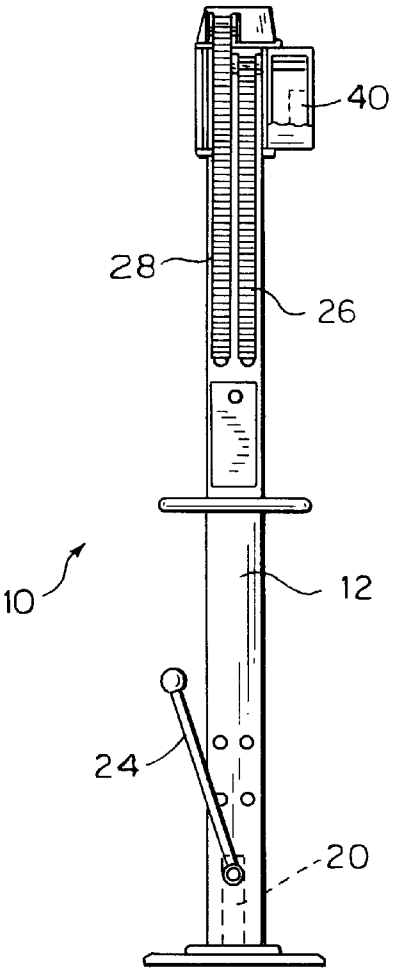
FIG. 3 is an enlarged drawing of the person lifter as shown in FIG. 1.
Figure 6:
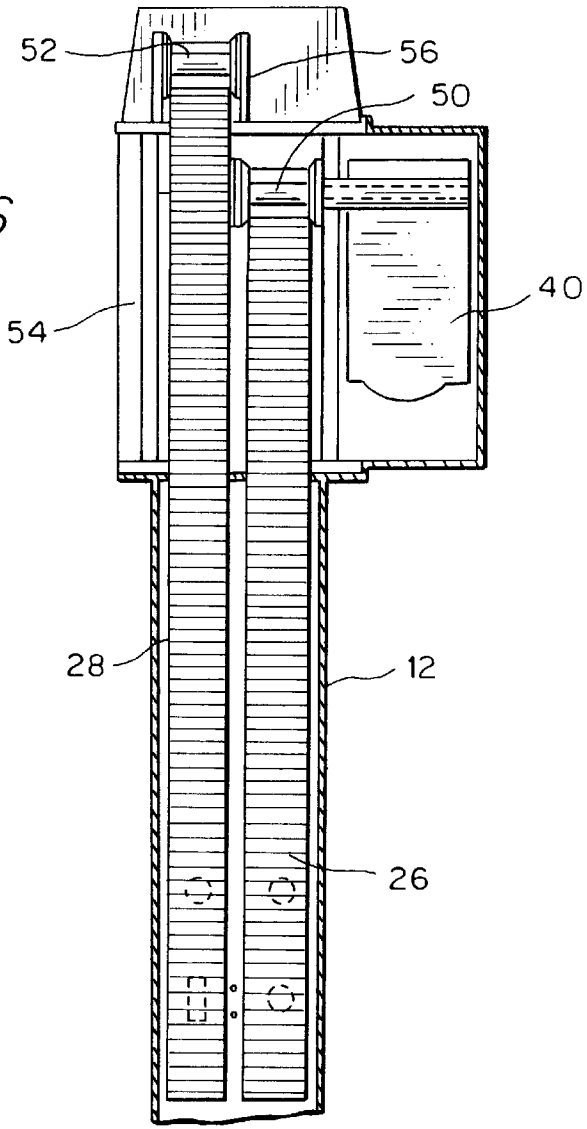
FIG. 6 is a drawing of the belts inside the guide of the person lifter.
Figure 5:
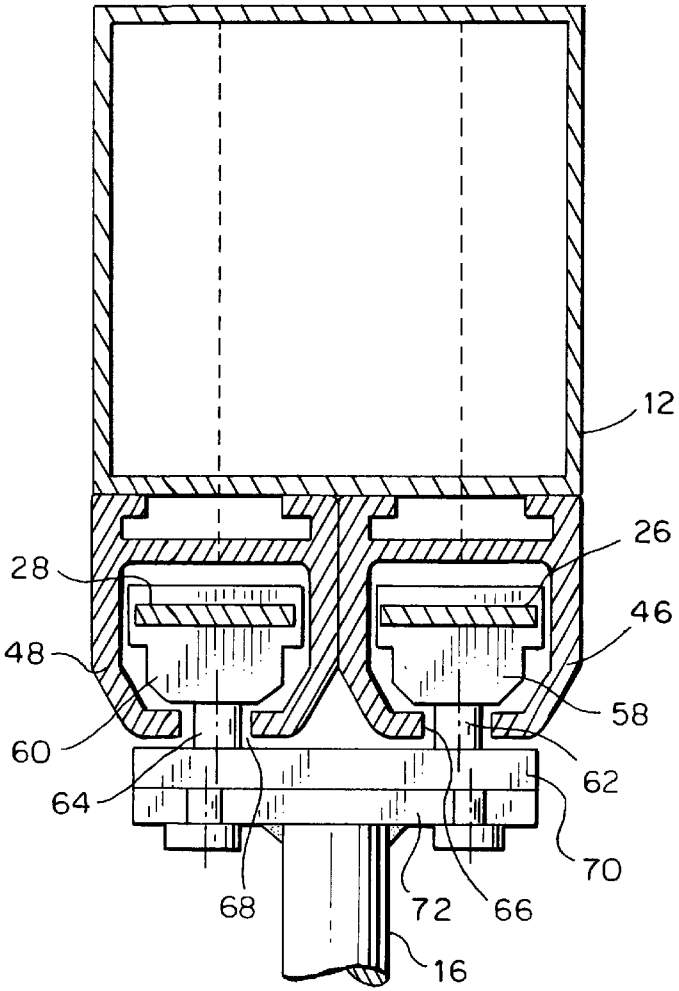
FIG. 5 is an enlarged cross-cut of the person lifter.

In the drawings, a person lifter (10) intended particularly as a pool lifter is shown purely schematically. The person lifter (10) includes a column (12) having a lifting arm (16) that begins at the column, can be raised or lowered along the longitudinal axis (14) of the column and has a seat (18) or for instance a gurney.

The column (12) is mounted on a shaft end (20) that begins at a base mount plate (22) that is to be secured at the place where the person lifter (10) according to the invention is to be used, or in other words for instance at the edge of the basin or pool.

Because the column (12) is secured by being mounted on the shaft end (20), it is possible to rotate the column about its longitudinal axis (14) to the desired extent without any restriction.

To enable a person to be transferred from a wheelchair or bed, for instance, onto the person holder (18) without the possibility that the column (12) might rotate out of position, a handle (24) begins at the column (12) and leads to a kind of eccentric brake that cooperates with the shaft end (20). If the eccentric brake, or some element of similar function, is locked via the handle (24), then it is pressed against the shaft end (20) in such a way that the column (12) cannot be rotated.

The eccentric brake is embodied especially by the fact that the handle can turn a shaft designed as a bolt (25). The bolt (25) passes through a sleeve (27) emerging from the column (12). The bolt (25) features an external thread and the sleeve (27) an internal thread. Depending of the lever's (24) direction of rotation (24) the bolt (25) is either inserted into or retracted from the column (12). Thus turning the lever (24) in the proper direction results in the end point of bolt (25) making contact with the shaft stub (20) and can be pressed against it. At this moment the column (12) can no longer be rotated about the shaft stub (20). In order to restore rotation, it is only necessary to move the lever (24) in the opposite direction so that the bolt (25) is retracted sufficiently from the shaft (20) to release it, i.e. to create a gap.

The lifting arm (16) is raised or lowered via a conveyor belt (26) that is guided inside the column (12). The drive of the conveyor belt (26) is effected via a battery-supplied electric motor, not shown. A battery (30) required for this purpose is replaceably disposed in the column. An emergency off switch (32) is located in this region, in order to turn off the drive for the conveyor belt (26).

A belt called catch belt (28) extends parallel to the conveyor belt (26) and is connected to the conveyor belt (26) via the lifting arm (16) or by a fastening plate. Thus if the lifting arm (16) and with it the person holder (18) is raised or lowered properly, the catch belt (28) moves synchronously with it. In the event of a malfunction, or in other words for example if the conveyor belt (26) breaks or if a brake acting upon it fails, then the catch belt (28) is caught firmly. To that end a mechanism is provided of the kind known from automobile safety belts (shown in suggested fashion in the drawing at the head of the column). Since the catch belt (28) is connected to the lifting arm (16), the lifting arm can consequently not be lowered further, so that there is no danger to a person.

If the belts (26) or (28) are not embodied as endless belts but rather—as in the exemplary embodiment—can be wound up and unwound at one end, then a cagging cable switch as in German Utility Model DE 91 10 218 may be provided in the column (12), and this switch assures that the belt (26) or (28) can be wound up or unwound only whenever the conveyor belt (26) is held taut inside the column (12). Should that not be the case, then the drive means for the conveyor belt (26) cannot be turned on. This provided additional security to the person to be raised or lowered.

It is understood that some other conveying or catching element that works the same way can be used instead of the belt (26) or (28), without departing from the scope of the invention.

Figure 7B:
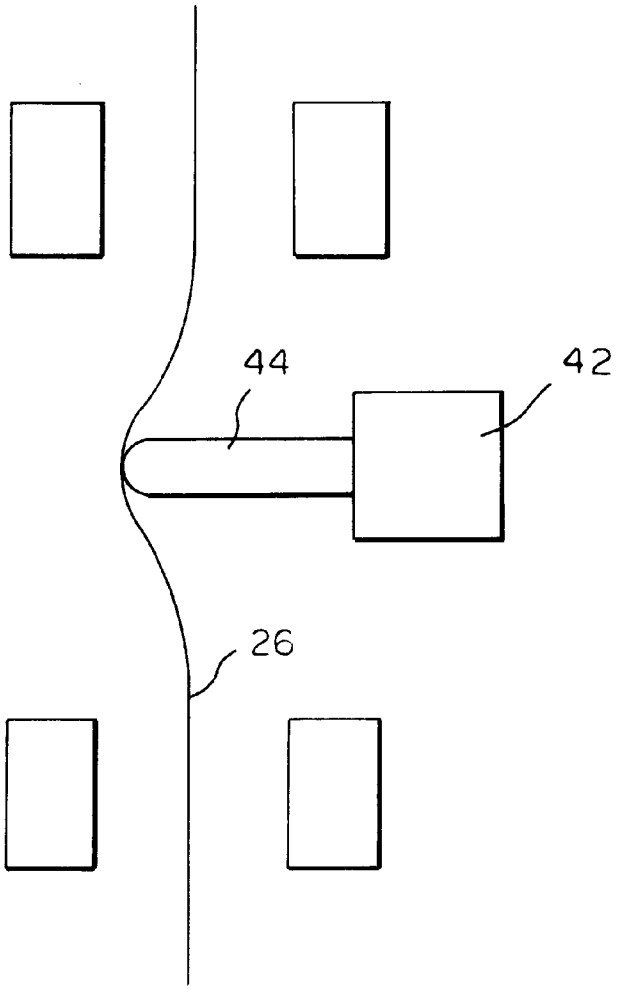
FIG. 7*b* a belt monitoring switch in OFF position.
Figure 7A:
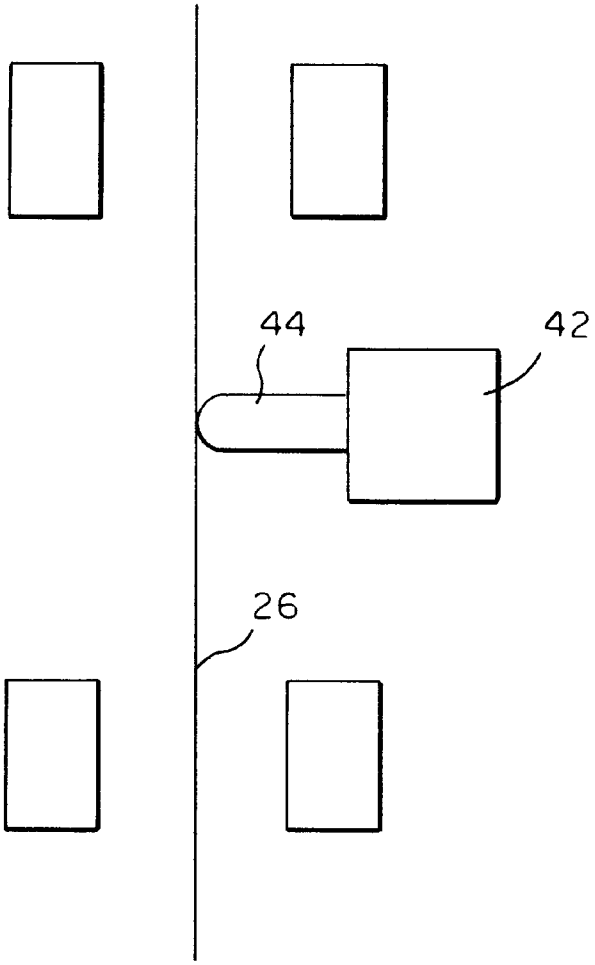
FIG. 7*a* a belt monitoring switch in ON position.

For the belt monitoring switch operation, reference is made to FIGS. 7*a*, 7*b*.

When person lifter is properly operated the hoisting belt (26) is under tension. When under tension the hoisting belt (26) presses against a switch (42) which is kept in an "on" position. This supplies the electric motor (41) with power. If during a disruption the hoisting belt (26) is no longer under tension, it no longer presses against the switch (42), i.e. to counter the thrust of its spring-loaded button (44). The force of the spring pushes the button (44) in the direction of the housing belt so that switch (42) changes to OFF. At this moment the electric motor (40) is switched off, i.e. can no longer be supplied with power.

The hoisting belt (26) as well as the catch belt (28) are guided in the u-shaped enclosures (46), (48) which start from the column. The belts (26), (28) start from shafts (50), (52) which are arranged in one housing (54). The housing (54) itself is fastened in the upper part of the column (12). The shaft (50) of the hoisting belt (26) can be set in rotation by means of the electrical motor (40), wind and unwind the belt (26). A gearbox can be positioned between the electrical motor and the shaft.

The shaft (52) for the catch belt (28) starts from a securing attachment. The shaft (52) is spring loaded in such a manner that shaft (52) exerts a constant pull to wind up catch belt 28.

The hoisting belt (26) and the catch belt (28) are clamped firmly at their ends furthest from the shafts (50), (52) in the securing attachments (58), (60) which in turn are enclosed in the u-shaped guides (46), (48). In order to insure a quiet operation of the securing attachments (58), (60) in the guides (16), (18) the securing attachments (58), (60) can be supported by gliding elements such as rollers against the inner walls of the guides (46), (48). As a result the securing attachments (58), (60) act like carriages or shuttles or are components of said shuttles.

The securing attachments (58), (60) feed through slot shaped opening (66), (68) with a shaft shaped stub (62), (64) of the u shaped guides (46), (48). Externally the shaft stubs (62), (64) are connected to the fastening plates (70), (72) from which in turn the lifting arm (16) for the seat (18) extends.

The catch belt (28) insures that the seat (18) does not slide uncontrolled down the side of the column (12), because in case the hoisting belt (26) is no longer being unwound by the motor (40) at the requisite lowering speed, the hoisting belt (26) may indeed be torn however, the catch belt (28) reacts to the acceleration and causes the shaft (52) to be locked, operating like a seat belt in a motor vehicle.

We claim:

1. A device for lifting a person from a pool comprising:

a base mount with a shaft extending along a longitudinal axis; a column extending from the base mount along the longitudinal axis and selectively rotatable with respect to the base mount; a drivable belt and a catch belt;

belt support mounted on a top end of the column, said belt support including a housing;

means to hold a person including a lifting arm having a first end attached to a person holding element and a second end attached to a device which is fixed to the drivable belt and to the catch belt;

said drivable and catch belt extending in parallel and moving synchronously along the longitudinal axis of the column during the lifting and lowering operation of a person; and said catch belt arresting movement when the speed of lowering of the person holding element exceeds a predetermined value.

2. The device according to claim 1, wherein the column includes a tube-shaped bottom end, said bottom end cooperating with the shaft to enable column rotation.

3. The device according to claim 2, including locking means to prevent column rotation relative to the base mount.

4. The device according to claim 1, further including a battery operated drive means for operating the drivable belt.

5. The device according to claim 4, wherein the person holding element is arranged on a first side of the column and the drive means having control elements are mounted on an opposite side.

6. The device according to claim 4, wherein the column includes a battery receptacle near the base mount and the drive means includes an emergency off switch to disable operation.

7. The device according to claim 4, further including a switch actuatable by the drivable belt, said switch means being kept in the ON position as long as the drivable belt is under tension, but changing to the OFF position when not under belt tension, so as to render the drive means inoperative.

8. The device according to claim 1, wherein the column includes U-shaped guides, the drivable belt is drawn through a first U-shaped guide and the catch belt is drawn through a second U-shaped guide, the first and second U-shaped guides being parallel to each other, said drivable belt and said catch belt are fastened in their individual guides to a first and second securing attachment contained in each of the corresponding guides, first and second elements extend through the U-shaped guides and are connected to the means to hold a person.

9. The device according to claim 8, wherein the first and second securing attachment are formed as shuttles capable of running inside the first and second U-shaped guide.

10. The device according to claim 4, wherein the drivable belt acts on a switch so that when the drivable belt is under tension, the drive means is supplied with battery power and when the drivable belt is not under tension, the battery power supply is cut off.

11. The device according to claim 2, including locking means to prevent column rotation relative to said base having a bolt connected to a lever, a sleeve with an internal thread connected to the column and a lever for turning the bolt to press against the base mount shaft until rotation is prevented.

* * * * *